US011661757B2

(12) United States Patent
Kostman

(10) Patent No.: US 11,661,757 B2
(45) **Date of Patent: *May 30, 2023**

(54) DEMOLITION TOOL

(71) Applicant: Corey R. Kostman, Troy, KS (US)

(72) Inventor: Corey R. Kostman, Troy, KS (US)

( * ) Notice: Subject to any disclaimer, the term of this patent is extended or adjusted under 35 U.S.C. 154(b) by 568 days.

This patent is subject to a terminal disclaimer.

(21) Appl. No.: 16/797,997

(22) Filed: Feb. 21, 2020

(65) Prior Publication Data

US 2020/0190836 A1 Jun. 18, 2020

Related U.S. Application Data

(63) Continuation-in-part of application No. 15/582,771, filed on May 1, 2017, now Pat. No. 10,603,776.

(60) Provisional application No. 62/349,642, filed on Jun. 13, 2016.

(51) Int. Cl.
*E04G 23/08* (2006.01)
*B25G 1/10* (2006.01)

(52) U.S. Cl.
CPC ..... *E04G 23/08* (2013.01); *B25G 1/10* (2013.01); *E04G 2023/085* (2013.01)

(58) Field of Classification Search
CPC ..... E04G 23/08; E04G 2023/085; B25G 1/10
USPC ..... 81/45
See application file for complete search history.

(56) References Cited

U.S. PATENT DOCUMENTS 441,979 A * 12/1890 Rohrbach et al. ..... B25F 1/00 7/138
1,389,820 A * 9/1921 Downey ..... E04G 23/08 D8/89
6,070,498 A * 6/2000 Mislich ..... E04D 15/003 30/169
7,730,809 B2 * 6/2010 Creato ..... E04D 15/02 81/45
2010/0207081 A1 * 8/2010 Liou ..... B25G 3/26 254/129
2017/0051521 A1 * 2/2017 Bridges ..... E04G 23/006

* cited by examiner

*Primary Examiner* — Hadi Shakeri
(74) *Attorney, Agent, or Firm* — Kali Law Group, P.C.

(57) ABSTRACT

Demolition tools are presented including: a handle having a proximal end and a distal end; a prying head disposed along the distal end of the handle, the prying head including at least two tines mechanically coupled with a substantially cylindrical cross frame, where the at least two tines each includes: an upper surface forming a width, a proximal end and a distal end; a tapered base including a first end forming a profile complementary to the substantially cylindrical cross frame, the tapered base mechanically coupled to the cylindrical cross frame at the proximal end of the upper surface along the profile, the tapered base tapering upward towards the upper surface from the first end towards the distal end of the upper surface, where the at least two tines each form a fulcrum point where the tapered base is coupled with the cross frame.

14 Claims, 7 Drawing Sheets

DEMOLITION TOOL

BACKGROUND

During the course of construction, remodeling, renovation, and deconstruction projects, it is often necessary for a laborer to break apart and tear out existing building structures and materials. These structures and materials are commonly held together with screws, nails, and adhesives. In many cases, joinery, such as "tongue-and-groove" interlocking flooring or window frames pressed together at the factory, may also be utilized to hold structures and materials together. In order to remove these structures and materials, hand tools are commonly utilized.

There exist in the market many hand tools that are designed to help complete this type work faster, easier, and at less cost. Most of these tools are each designed primarily to carry out a specific function such as prying, cutting, hammering, breaking, puncturing, or penetrating. In order to save time, money, and energy required to complete this work, it is in the worker's best interest to use a tool that is well suited for multiple functions within the demolition classification. Subtle differences in design characteristics of these tools make big differences in how effective or ineffective they are in helping a worker complete the desired task. Thus, the most helpful and valuable tools of this type are multifunctional and durable. As such, demolition tools are presented herein.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented below.

As such, demolition tools are presented including: a handle having a proximal end and a distal end; a prying head disposed along the distal end of the handle, the prying head including at least two tines mechanically coupled with a substantially cylindrical cross frame, where the at least two tines each includes: an upper surface forming a width, a proximal end and a distal end; a tapered base including a first end forming a profile complementary to the substantially cylindrical cross frame, the tapered base mechanically coupled to the cylindrical cross frame at the proximal end of the upper surface along the profile, the tapered base tapering upward towards the upper surface from the first end towards the distal end of the upper surface, where the at least two tines each form a fulcrum point where the tapered base is coupled with the cross frame. In some embodiments, the handle further includes a reinforcing gusset mechanically coupled with the prying head. In some embodiments, the handle further includes at least three bends along a handle length. In some embodiments, demolition tools further include: a first bend angle of approximately 10 degrees at a first of the at least three bends; a second bend angle of approximately −6 degrees at a second of the at least three bends; and a third bend angle of approximately −4 degrees at a third of the at least three bends. In some embodiments, demolition tools further include: a striking head mechanically coupled with and disposed along at least one end of the cross frame. In some embodiments, the width of each tines has a width is in a range of approximately 0.4375 to 0.7500 inches. In some embodiments, demolition tools further include: the prying head includes at most six tines mechanically coupled with the cross frame. In some embodiments, demolition tools further include: the substantially cylindrical cross frame includes a rectangular cross-sectional profile.

In other embodiments, demolition tools are presented including: a handle having a proximal end and a distal end; a prying head disposed along the distal end of the handle, the prying head including at least two tines mechanically coupled with a substantially cylindrical cross frame, where the at least two tines each includes: an upper surface forming a width, a proximal end and a distal end; a tapered base portion including a first end forming a profile complementary to the substantially cylindrical cross frame, the tapered base portion mechanically coupled to the cylindrical cross frame at the proximal end of the upper surface along the profile, the tapered base portion tapering upward towards the upper surface from the first end to a second end; and a tapered end extending from the tapered base portion towards the distal end of the upper surface, where the at least two tines each form a first fulcrum point where the tapered end extends from the tapered base portion and a second fulcrum point where the tapered base portion is coupled with the cross frame.

In other embodiments, demolition tools are presented including: a handle having a proximal end and a distal end; a prying head disposed along the distal end of the handle, the prying head including at least two tines mechanically coupled with a substantially cylindrical cross frame, where the at least two tines each includes: an upper surface forming a width, a proximal end and a distal end; a base portion including a first end forming a profile complementary to the substantially cylindrical cross frame, the base portion mechanically coupled to the cylindrical cross frame at the proximal end of the upper surface along the profile, the base portion having a circular cross section and extending from the first end to a second end; and a tapered end extending from the base portion towards the distal end of the upper surface, where the at least two tines each form a first fulcrum point where the tapered end extends from the base portion and a second fulcrum point where the base portion is coupled with the cross frame.

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes, and may not have been selected to delineate or circumscribe the inventive subject matter.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION

The present invention will now be described in detail with reference to a few embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

Because construction materials are typically bonded together using method specifically designed to keep them stable over long periods of time, tearing these materials apart can be strenuous and time consuming work and can add considerable expense to a job. Demolition, as this is commonly referred to as, is usually expensive because tooling and labor costs can easily rise with the complexity and volume of materials to be reduced. One problem with existing demolition tools are that existing demolition tools are somewhat specialized in their functionality, which effectively limits their usefulness. Thus, a laborer may be required to purchase several tools to complete a project, which can be expensive and inconvenient. In some examples, multi-use tools may be available. However, conventional multi-use tools may lack design characteristics that help a laborer to maximize the use of leverage, momentum, weight, and sharpness to create the forces necessary to tear apart materials the fastest and most efficient way possible. Embodiments disclosed herein attempt to overcome such limitations.

Figure 1:
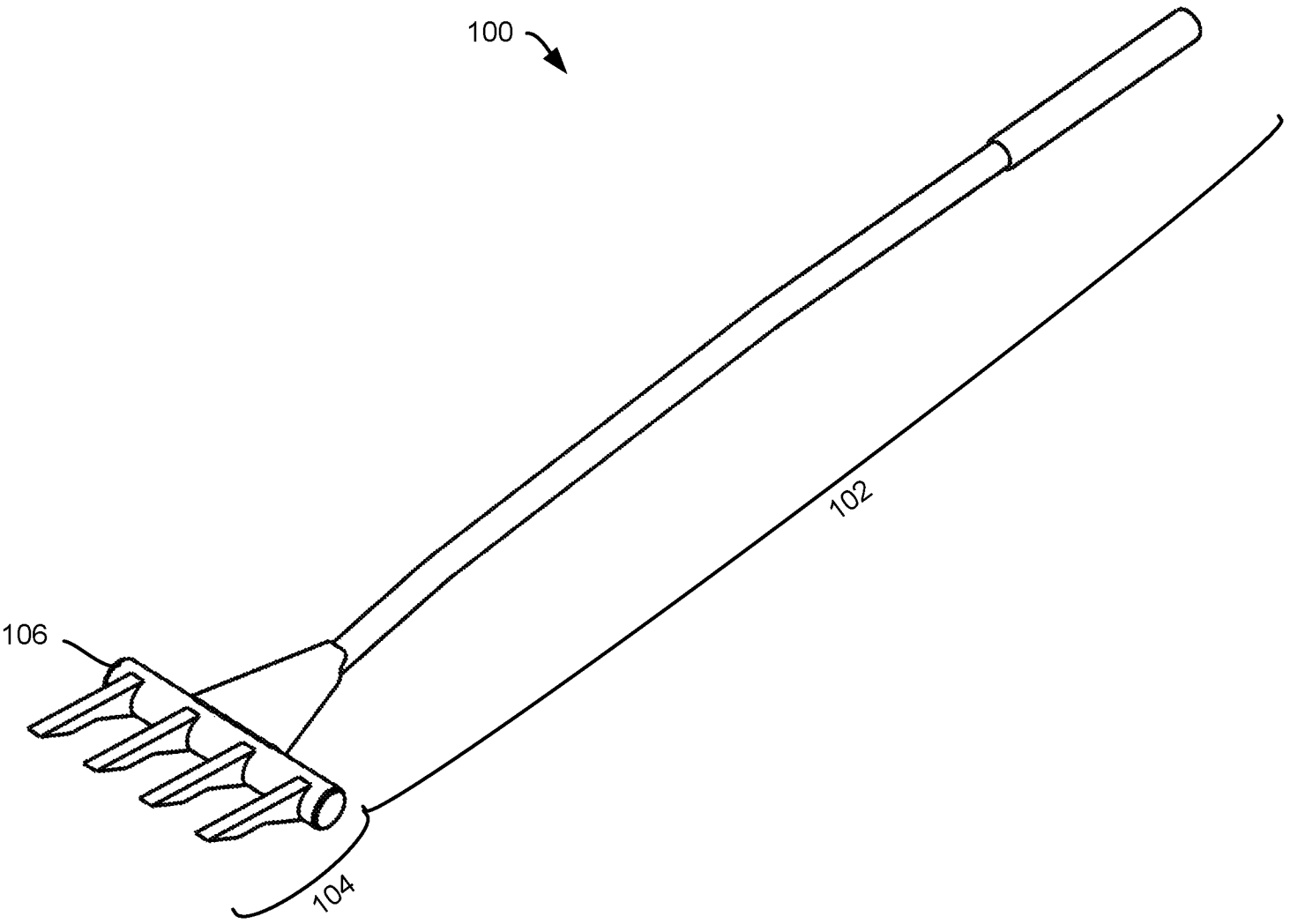
FIG. 1 is an illustrative representation of a demolition tool in accordance with embodiments of the present invention.

FIG. 1 is an illustrative representation of demolition tool 100 in accordance with embodiments of the present invention. As illustrated, demolition tool 100 includes handle 102 having a proximal end and a distal end; prying head 104 disposed along the distal end of handle 102—the prying head including tines coupled with a cross frame; and striking head 106 mechanically coupled with and disposed along at least one end of the cross frame of prying head 104. As such, embodiments may be utilized to pierce, sever, pry, wedge, and hammer on materials. Each aspect of demolition tool 100 will be discussed in further detail below.

Figure 2:
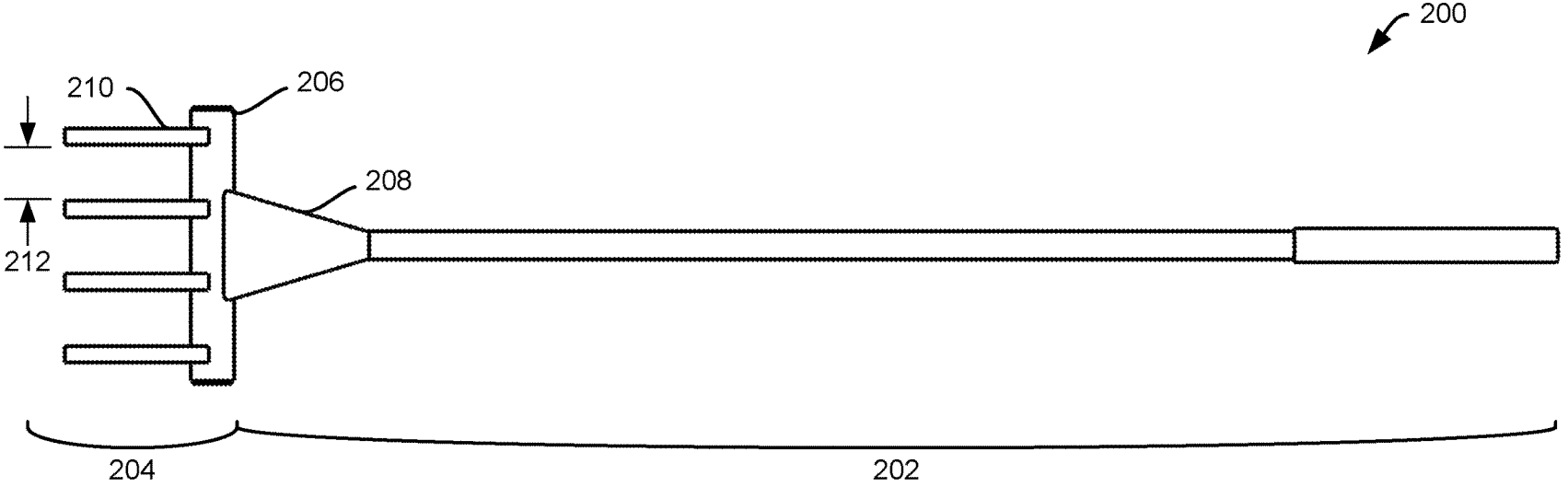
FIG. 2 is an illustrative top view representation of a demolition tool in accordance with embodiments of the present invention.

FIG. 2 is an illustrative top view representation of demolition tool 200 in accordance with embodiments of the present invention. As illustrated, demolition tool 200 includes handle 202 having a proximal end and a distal end; prying head 204 disposed along the distal end of handle 202—the prying head including tines coupled with a cross frame; and striking head 206 mechanically coupled with and disposed along at least one end of the cross frame of prying head 204. As above, embodiments may be utilized to pierce, sever, pry, wedge, and hammer on materials. In addition, in some embodiments, reinforcing gusset 208 may be mechanically coupled with prying head 204. Reinforcing gussets may provide additional stability of demolition tool embodiments. It may be appreciated that tines 210 may be spaced to accommodate different sized materials. For example, in embodiments, tines may be spaced to accommodate standard 2×4 lumber such that the narrow side of the lumber may slip between the tines. This spacing may be useful in applying rotating force on a piece of lumber. In some embodiments, tines may be spaced in a range of approximately 1.00 to 3.00 inches without limitation.

Figure 3:
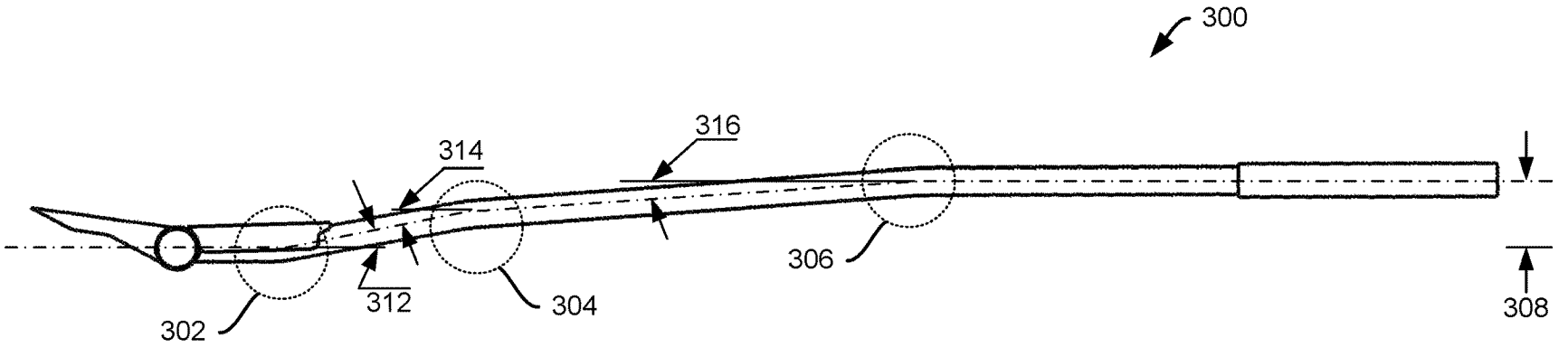
FIG. 3 is an illustrative side view representation of a demolition tool in accordance with embodiments of the present invention.

FIG. 3 is an illustrative side view representation of demolition tool 300 in accordance with embodiments of the present invention. As illustrated, demolition tool 300 includes bends 302, 304, and 306. One purpose of the bends is to offset distal and proximal ends of the handles. Another purpose of the bends is to provide an ergonomic handle. Another purpose of the bends is to provide additional leverage in some positions. In embodiments, the distal end and the proximal end are substantially parallel and are offset 308 by at least 1.50 inches due to the bends. Accordingly, in one embodiment illustrated, bend 302 has bend angle 312 of approximately 10 degrees; bend 304 has bend angle 314 of approximately −6 degrees; and bend 306 has bend angle 316 of approximately −4 degrees. Importantly, a variety of bend angles may be utilized without departing from embodiments provided herein. In addition, a variety of handle lengths may be utilized without departing from embodiments provided herein. For example, in some embodiments, handles may have a length in a range of approximately 24 inches to 64 inches.

Figure 4:
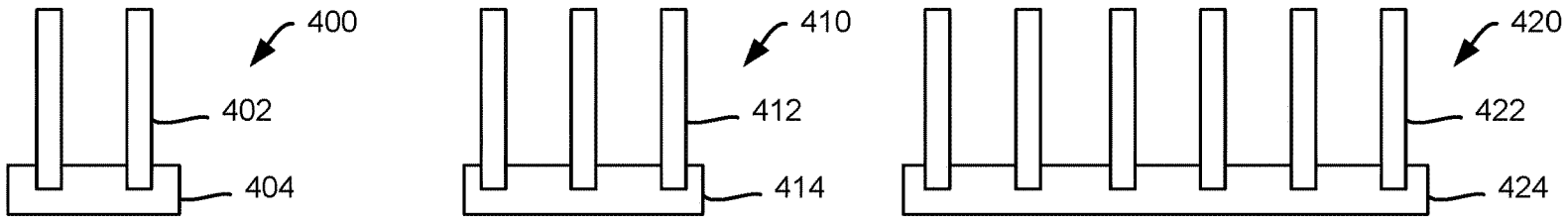
FIG. 4 is an illustrative view representation of various prying head configurations in accordance with embodiments of the present invention.

FIG. 4 is an illustrative view representation of various prying head configurations in accordance with embodiments of the present invention. In particular prying head 400 includes two tines 402 coupled with cross frame 404; prying head 410 includes three tines 412 coupled with cross frame 414; and prying head 420 includes six tines 422 coupled with cross frame 424. Therefore, as may be appreciated, a variety of tine configurations may be utilized differing in both number and spacing without departing from embodiments provided herein. For example, having fewer tines may provide a demolition tool that may be utilized in narrow spaces while having more tines may provide a demolition tool that may utilized in a larger work area more efficiently. In application, embodiments may include from two to six tines.

Figure 5:
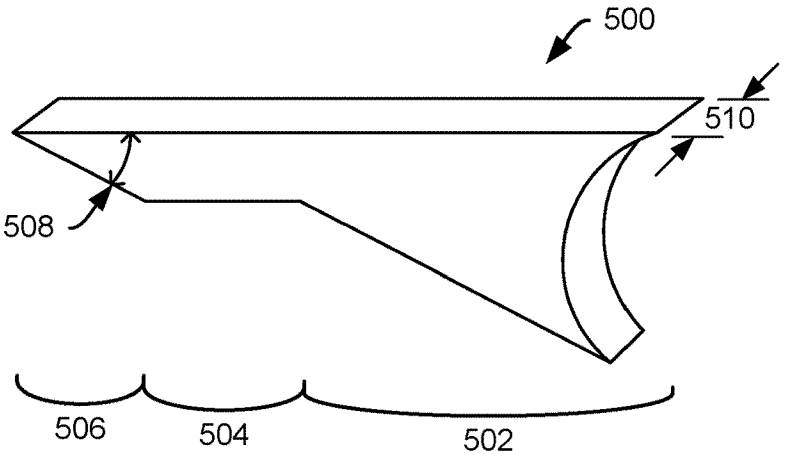
FIG. 5 is an illustrative view representation of a demolition tool tine in accordance with embodiments of the present invention.

FIG. 5 is an illustrative view representation of tine 500 of a demolition tool in accordance with embodiments of the present invention. As illustrated, tine 500 includes base 502; body 504 that extends from base 502; and tapered end 506 that extends from body 504. Further illustrated, tapered end 506 may have an angle 508 of approximately 20 degrees in embodiments. Still further tine 500 may include width 510 that may be in a range of approximately 0.4375 to 0.7500 inches. It may be appreciated that tine embodiments may coupled with cross frames illustrated above in any manner known in the art without limitation. Furthermore, tines may be manufactured from a variety of materials including, with limitation, steel, high carbon steel, tempered steel, aluminum, and the like. In some embodiments, tines may be hardened.

Figure 6:
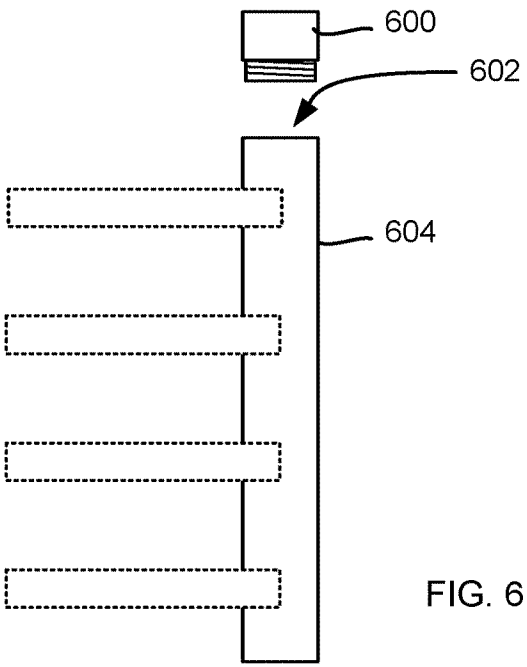
FIG. 6 is an illustrative view representation of a removable striking head of a demolition tool in accordance with embodiments of the present invention.

FIG. 6 is an illustrative view representation of a removable striking head 600 of a demolition tool in accordance with embodiments of the present invention. As illustrated, removable striking head 600 may be removably coupled with cross frame 604. In embodiments, removable striking heads may have a weight in the range of approximately 10 to 50 ounces. In some embodiments, cross frame 604 may define a hollow cavity 602 that may received loose weights such as lead or steel pellets to provide a dead blow action to demolition tool embodiments. A variety of weight combinations are possible using pellets without departing from embodiments provided herein.

Figure 7:
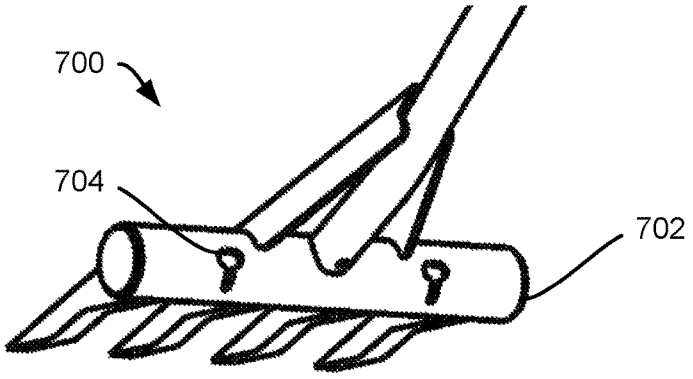
FIG. 7 is an illustrative representation of a demolition tool with a keyhole nail remover in accordance with embodiments of the present invention.
Figure 8:
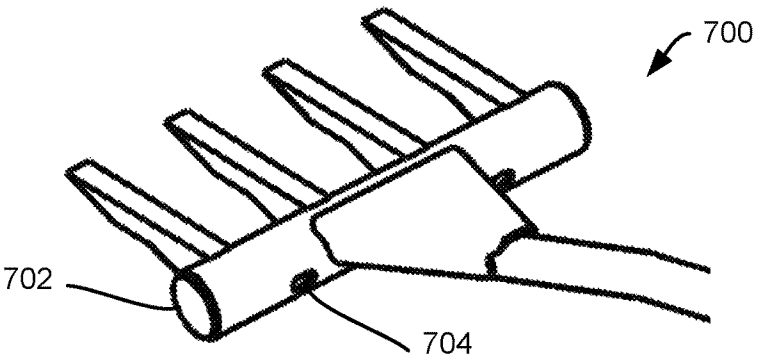
FIG. 8 is an illustrative representation of a demolition tool with a keyhole nail remover in accordance with embodiments of the present invention.

Referring to FIGS. 7 and 8, which are illustrative representations of a demolition tool 700 with keyhole nail remover 704 in accordance with embodiments of the present invention. As may be seen, keyhole nail remover 704 may be positioned along back side of cross frame 702. In use, a protruding nail may be captured by its head in keyhole nail remover 704, whereupon a user may then lift out an embedded nail. As may be seen, the tines and handle function in unison provide the leverage required for lifting out an embedded nail. Keyhole nail remover embodiments may be machined or formed in any manner known in the art without departing from embodiments provided herein. Although two keyhole nail removers are illustrated, embodiments require one or more keyhole nail removers, which may be positioned anywhere along the backside of the cross frame.

Figure 9:
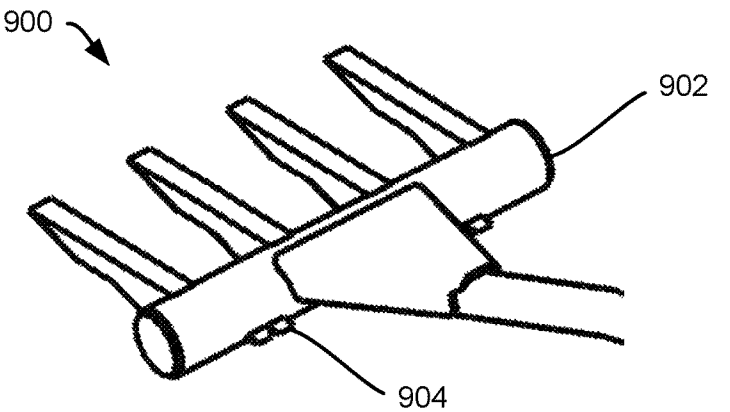
FIG. 9 is an illustrative representation of a demolition tool with a tabbed nail remover in accordance with embodiments of the present invention.
Figure 10:
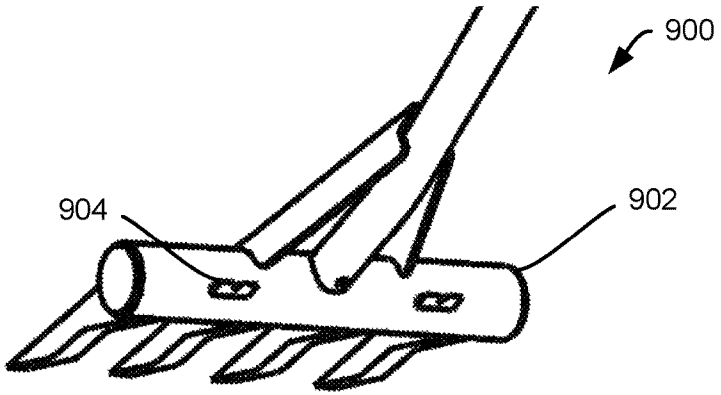
FIG. 10 is an illustrative representation of a demolition tool with a tabbed nail remover in accordance with embodiments of the present invention.

Referring to FIGS. 9 and 10, which are illustrative representations of a demolition tool 900 with tabbed nail remover 904 in accordance with embodiments of the present invention. As may be seen, tabbed nail remover 904 may be positioned along back side of cross frame 902. In use, a protruding nail may be captured by its head by tabbed nail remover 904, whereupon a user may then lift out an embedded nail. The tabs provide a slot that may be angled or straight in embodiments. In some embodiments, tabs may extend from the cross frame in a range of 0.50 to 1.50 inches and may be wedge shaped in profile. As may be seen, the tines and handle function in unison to provide the leverage required for lifting out an embedded nail. Although two tabbed nail removers are illustrated, embodiments require one or more tabbed nail removers, which may be positioned anywhere along the backside of the cross frame.

ALTERNATE EMBODIMENTS

Figure 11:
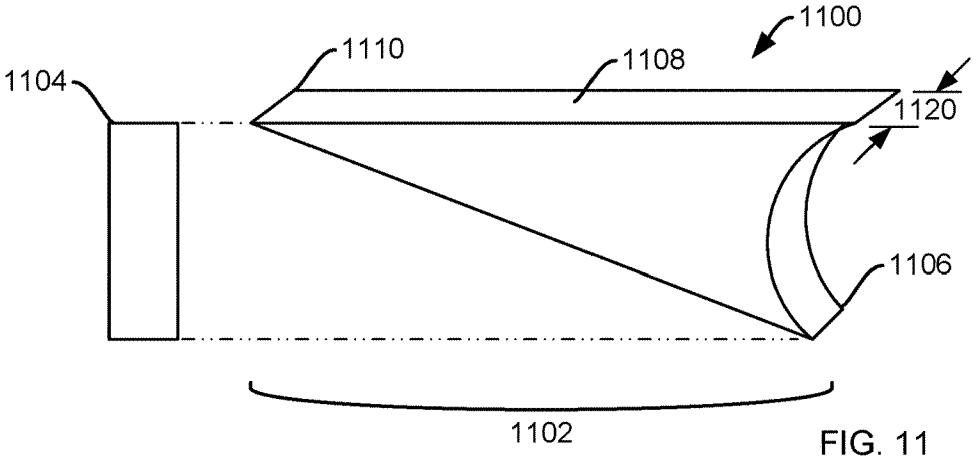
FIG. 11 is an illustrative view representation of a demolition tool tine in accordance with embodiments of the present invention.

FIG. 11 is an illustrative view representation of a demolition tool tine 1100 in accordance with embodiments of the present invention. As illustrated, tine 1100 includes tapered base 1102 that is continuously tapered from end 1106 positioned with the proximal end of upper surface 1108 to end 1110 located at the distal end of upper surface 1108. It is noted that a fulcrum point is located where the tapered base is coupled with the cross frame. Further illustrated is profile view 1104 that shows a rectangular profile of tine 1100. In embodiments, tapered base has an angle of approximately 20 degrees with respect to the upper surface. Still further tine 1100 may include width 1120 that may be in a range of approximately 0.4375 to 0.7500 inches. It may be appreciated that tine embodiments are coupled with cross frames illustrated above in any manner known in the art without limitation. Furthermore, tines may be manufactured from a variety of materials including, with limitation, steel, high carbon steel, tempered steel, aluminum, and the like. In some embodiments, tines may be hardened.

Figure 12:
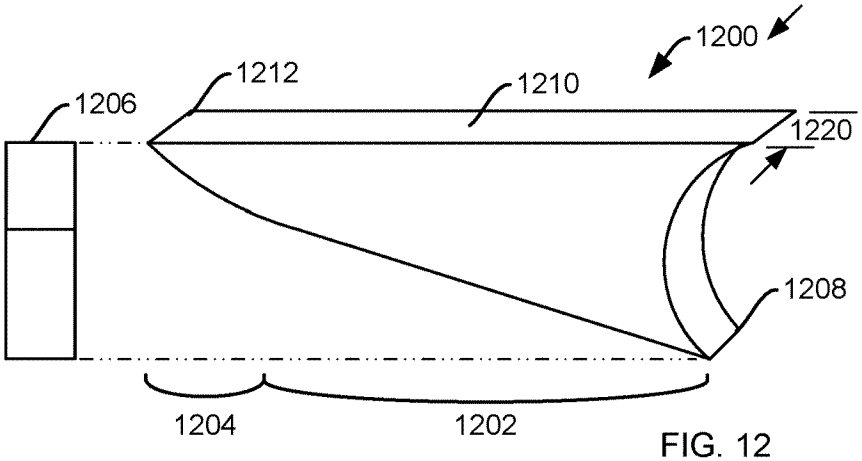
FIG. 12 is an illustrative view representation of a demolition tool tine in accordance with embodiments of the present invention.

FIG. 12 is an illustrative view representation of a demolition tool tine 1200 in accordance with embodiments of the present invention. As illustrated, tine 1200 includes tapered base portion 1202 that is tapered from end 1208 positioned with the proximal end of upper surface 1210 to tapered end 1204, which tapers in curved fashion to end 1212 of upper surface 1210. It is noted that the tapered end forms a first fulcrum point for demolition tool embodiments where the tapered end meets the tapered base portion. A second fulcrum point is located where the base portion is coupled with the cross frame. Further illustrated is profile view 1206 that shows a rectangular profile of tine 1200. Still further tine 1200 may include width 1220 that may be in a range of approximately 0.4375 to 0.7500 inches. It may be appreciated that tine embodiments are coupled with cross frames illustrated above in any manner known in the art without limitation. Furthermore, tines may be manufactured from a variety of materials including, with limitation, steel, high carbon steel, tempered steel, aluminum, and the like. In some embodiments, tines may be hardened.

Figure 13:
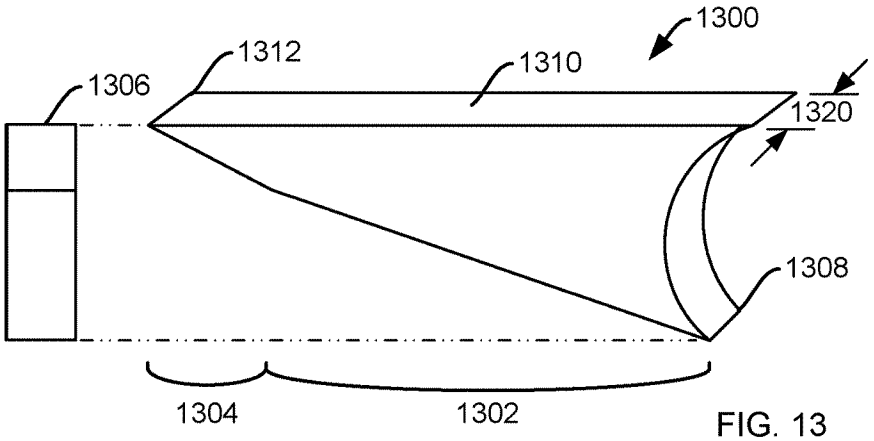
FIG. 13 is an illustrative view representation of a demolition tool tine in accordance with embodiments of the present invention.

FIG. 13 is an illustrative view representation of a demolition tool tine 1300 in accordance with embodiments of the present invention. As illustrated, tine 1300 includes tapered base portion 1302 that is tapered from end 1308 positioned with the proximal end of upper surface 1310 to tapered end 1304, which tapers to end 1312 of upper surface 1310. It is noted that the tapered end forms a first fulcrum point for demolition tool embodiments where the tapered end meets the tapered base portion. A second fulcrum point is located where the base portion is coupled with the cross frame in embodiments. Further illustrated is profile view 1306 that shows a rectangular profile of tine 1300. In embodiments, tapered end has an angle of approximately 20 degrees with respect to the upper surface. Still further tine 1300 may include width 1320 that may be in a range of approximately 0.4375 to 0.7500 inches. It may be appreciated that tine embodiments are coupled with cross frames illustrated above in any manner known in the art without limitation. Furthermore, tines may be manufactured from a variety of materials including, with limitation, steel, high carbon steel, tempered steel, aluminum, and the like. In some embodiments, tines may be hardened.

Figure 14:
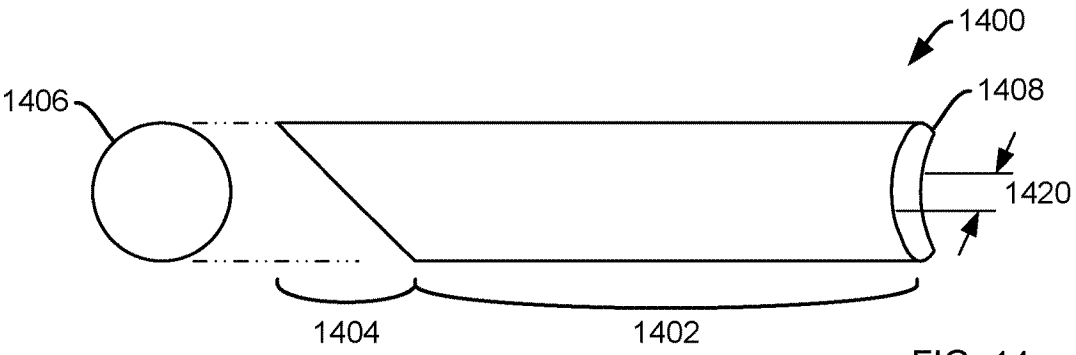
FIG. 14 is an illustrative view representation of a demolition tool tine in accordance with embodiments of the present invention.

FIG. 14 is an illustrative view representation of a demolition tool tine 1400 in accordance with embodiments of the present invention. In particular, FIG. 14 illustrates a round tine having a conical tip. As illustrated, tine 1400 includes base portion 1402 having a circular cross section from end 1408 to tapered end 1404, which tapers continuously to an edge. It is noted that the tapered end forms a first fulcrum point for demolition tool embodiments where the tapered end meets the base portion. A second fulcrum point is located where the base portion is coupled with the cross frame in embodiments. Further illustrated is profile view 1406 that shows a circular profile of tine 1400. Still further tine 1400 may include width 1420 that may be in a range of approximately 0.4375 to 0.7500 inches. It may be appreciated that tine embodiments are coupled with cross frames illustrated above in any manner known in the art without limitation. Furthermore, tines may be manufactured from a variety of materials including, with limitation, steel, high carbon steel, tempered steel, aluminum, and the like. In some embodiments, tines may be hardened.

Figure 15:
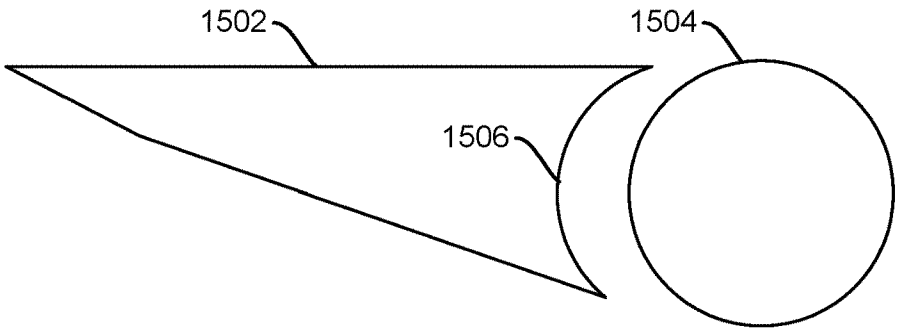
FIG. 15 is an illustrative view representation of a demolition tool tine in accordance with embodiments of the present invention.

FIG. 15 is an illustrative view representation of a demolition tool tine 1502 in accordance with embodiments of the present invention. It may be appreciated that cylindrical cross frame embodiments may include different cross-sectional profiles. In FIG. 15, tine 1502 is permanently coupled with cylindrical cross frame 1504 along profile 1506. As illustrated, cylindrical cross frame 1504 has a circular cross-sectional profile. In some embodiments, cylindrical cross frames are filled or solid.

Figure 16:
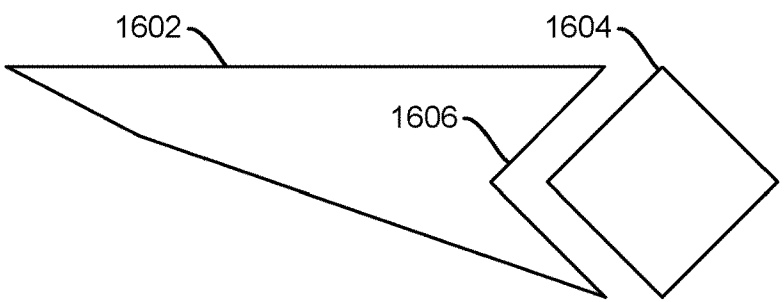
FIG. 16 is an illustrative view representation of a demolition tool tine in accordance with embodiments of the present invention.

FIG. 16 is an illustrative view representation of a demolition tool tine 1602 in accordance with embodiments of the present invention. It may be appreciated that cylindrical cross frame embodiments may include different cross-sectional profiles. In FIG. 16, tine 1602 is permanently coupled with cylindrical cross frame 1604 along profile 1606. As illustrated, cylindrical cross frame 1604 has a rectangular cross-sectional profile. In some embodiments, cylindrical cross frames are filled or solid. These figures are presented for clarity in understanding that any number of cross-sectional profiles for cross frames may be utilized by one skilled in the art without limitation and without departing from embodiments disclosed herein.

Figure 17:
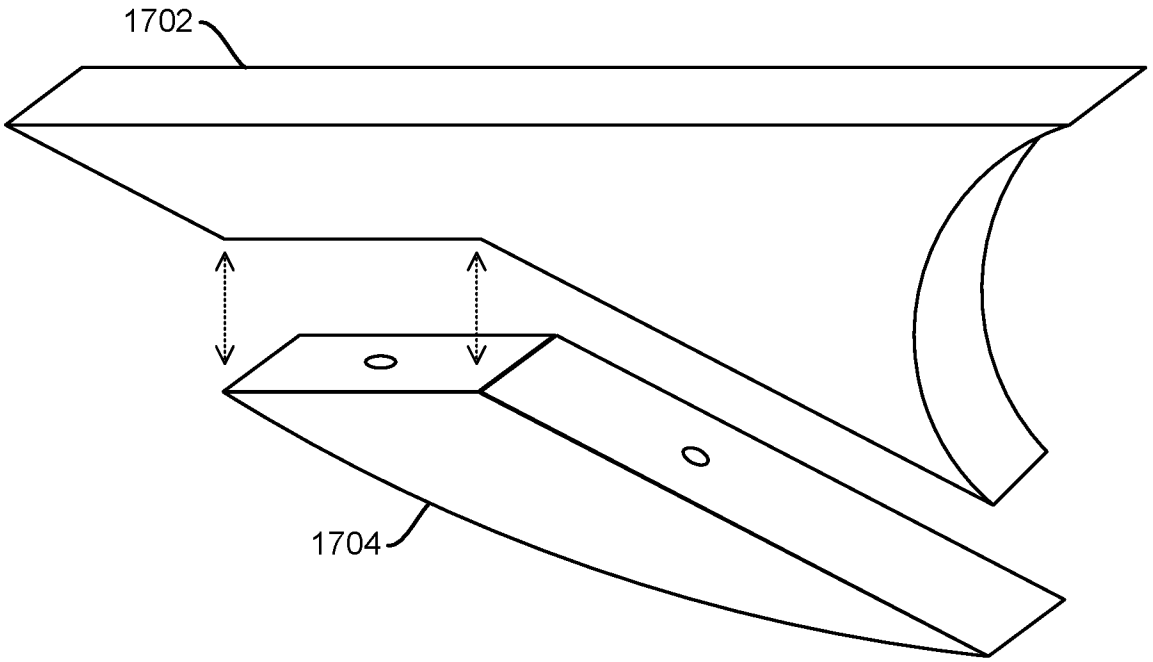
FIG. 17 is an illustrative view representation of a demolition tool tine with non-marring pad in accordance with embodiments of the present invention.

FIG. 17 is an illustrative view representation of a demolition tool tine 1702 with non-marring pad 1704 in accordance with embodiments of the present invention. It may be appreciated that in some demolition circumstances, a non-marring pad may be useful to reduce or avoid damage to an underlying substrate. For example, when removing tile from a concrete surface, it may be desirable to avoid damaging the concrete where new tile will be installed over the existing substrate. As such, a non-marring pad may be removably coupled with demolition tine embodiments as disclosed herein. Non-marring pads may be manufactured from a metallic or a polymeric material without limitation. In some embodiments, non-marring pads are manufactured from high density polyethylene. In embodiments, non-marring pads may be bolted, riveted, glued or otherwise mechanically coupled with tines without limitation.

The terms "certain embodiments", "an embodiment", "embodiment", "embodiments", "the embodiment", "the embodiments", "one or more embodiments", "some embodiments", and "one embodiment" mean one or more (but not all) embodiments unless expressly specified otherwise. The terms "including", "comprising", "having" and variations thereof mean "including but not limited to", unless expressly specified otherwise. The enumerated listing of items does not imply that any or all of the items are mutually exclusive, unless expressly specified otherwise. The terms "a", "an" and "the" mean "one or more", unless expressly specified otherwise.

While this invention has been described in terms of several embodiments, there are alterations, permutations, and equivalents, which fall within the scope of this invention. It should also be noted that there are many alternative ways of implementing the methods and apparatuses of the present invention. Furthermore, unless explicitly stated, any method embodiments described herein are not constrained to a particular order or sequence. Further, the Abstract is provided herein for convenience and should not be employed to construe or limit the overall invention, which is expressed in the claims. It is therefore intended that the following appended claims be interpreted as including all such alterations, permutations, and equivalents as fall within the true spirit and scope of the present invention.

What is claimed is:

1. A demolition tool comprising:

a handle having a proximal end and a distal end;

a prying head disposed along the distal end of the handle, the prying head including at least two tines mechanically and directly coupled with a substantially cylindrical hollow cross frame, wherein the cylindrical hollow cross frame has a circular cross-section profile and wherein the at least two tines each comprises:

an upper surface forming a width, a surface proximal end and a surface distal end;

a tapered base including a tine proximal end forming a profile complementary to the substantially cylindrical hollow cross frame, the tapered base mechanically coupled to the substantially cylindrical hollow cross frame at the surface proximal end of the upper surface along the profile, the tapered base tapering upward towards the upper surface from the tine proximal end towards the surface distal end of the upper surface, wherein the at least two tines each form a first fulcrum point where the tapered base is coupled with the cylindrical hollow cross frame, and wherein the cylindrical hollow cross frame forms additional fulcrum points between the at least two tines.

2. The demolition tool of claim 1, wherein the handle further comprises a reinforcing gusset mechanically coupled with the prying head.

3. The demolition tool of claim 1, wherein the handle further comprises at least three bends along a handle length.

4. The demolition tool of claim 3, further comprising:

a first bend angle of approximately 10 degrees at a first of the at least three bends;

a second bend angle of approximately −6 degrees at a second of the at least three bends; and a third bend angle of approximately −4 degrees at a third of the at least three bends.

5. The demolition tool of claim 1, further comprising:

a striking head mechanically coupled with and disposed along at least one end of the substantially cylindrical hollow cross frame.

6. The demolition tool of claim 1, wherein the width of each tines has a width is in a range of approximately 0.4375 to 0.7500 inches.

7. The demolition tool of claim 1, wherein the at least two tines are spaced from one another at a range of approximately 1.0 to 3.0 inches.

8. The demolition tool of claim 1, wherein the prying head includes at most six tines mechanically and directly coupled with the substantially cylindrical hollow cross frame.

9. The demolition tool comprising:

a handle having a proximal end and a distal end;

a prying head disposed along the distal end of the handle, the prying head including at least two tines mechanically and directly coupled with a substantially cylindrical hollow cross frame, wherein the cylindrical hollow cross frame has a circular cross-section profile and wherein the at least two tines each comprises:

an upper surface forming a width, a surface proximal end and a surface distal end;

a tapered base portion including a first end forming a profile complementary to the substantially cylindrical hollow cross frame, the tapered base portion mechanically coupled to the substantially cylindrical hollow cross frame at the surface proximal end of the upper surface along the profile, the tapered base portion tapering upward towards the upper surface from the first end to the surface distal end; and a tapered end extending from the tapered base portion towards the tine distal end of the upper surface, wherein the at least two tines each form a first fulcrum point where the tapered end extends from the tapered base portion and a second fulcrum point where the tapered base portion is coupled with the substantially cylindrical hollow cross frame, and wherein the cross frame forms additional fulcrum points between the at least two tines.

10. The demolition tool of claim 9, wherein the tapered end is tapered along an underside of each tine at an angle of approximately 20 degrees with respect to the upper surface.

11. The demolition tool of claim 9, wherein the tapered end is curved toward the upper surface along an underside of each tine.

12. The demolition tool comprising:

a handle having a proximal end and a distal end;

a prying head disposed along the distal end of the handle, the prying head including at least two tines mechanically and directly coupled with a substantially cylindrical hollow cross frame, wherein the cylindrical hollow cross frame has a circular cross-section profile and wherein the at least two tines each comprises:

an upper surface forming a width, a proximal surface end and a surface distal end; a base portion including a first end forming a profile complementary to the substantially cylindrical hollow cross frame, the base portion mechanically coupled to the substantially cylindrical hollow cross frame at the surface proximal end of the upper surface along the profile, the base portion having a circular cross section and extending from the first end to the surface distal end; and a tapered end extending from the base portion towards the distal end of the upper surface, wherein the at least two tines each form a first fulcrum point where the tapered end extends from the base portion and a second fulcrum point where the base portion is coupled with the substantially cylindrical hollow cross frame, and wherein the cross frame forms additional fulcrum points between the at least two tines.

13. The demolition tool of claim 1, wherein the cylindrical hollow cross frame is filled with loose weights.

14. The demolition tool of claim 9, wherein the cylindrical hollow cross frame is filled with loose weights.

* * * * *